US005246301A

United States Patent [19]

Hirasawa

[11] Patent Number: 5,246,301

[45] Date of Patent: Sep. 21, 1993

[54] BRUSH-TYPE SHOWER HEAD

[75] Inventor: Nobuo Hirasawa, Nagaoka, Japan

[73] Assignee: Toyo Denki Kogyo K.K., Niigata, Japan

[21] Appl. No.: 818,562

[22] Filed: Jan. 9, 1992

[30] Foreign Application Priority Data

Jan. 17, 1991 [JP] Japan ..... 3-941[U]

[51] Int. Cl.[5] ..... A46B 11/00; A46B 11/06

[52] U.S. Cl. ..... 401/28; 401/44; 401/46; 401/289; 401/290

[58] Field of Search ..... 401/28, 289, 290, 291, 401/282, 285, 44, 45, 46, 47; 15/202

[56] References Cited

U.S. PATENT DOCUMENTS

| | | | |
|---|---|---|---|
| 711,544 | 10/1902 | Tesch | 401/282 X |
| 805,431 | 11/1905 | Fetters | 15/202 |
| 873,852 | 12/1907 | Fetters | 15/202 |
| 1,062,041 | 5/1913 | Sennevoy | 15/202 |
| 1,191,578 | 7/1916 | Englund | 401/28 |
| 1,462,400 | 7/1923 | Warren | 401/28 X |
| 1,772,501 | 8/1930 | Shelton | 401/28 X |
| 1,965,344 | 7/1934 | Josinsky | 401/28 |
| 2,238,603 | 4/1941 | Runnels | 15/202 X |
| 2,250,878 | 7/1941 | Quaranti | 401/28 |
| 2,584,631 | 2/1952 | Soss | 401/28 X |

FOREIGN PATENT DOCUMENTS

| | | | |
|---|---|---|---|
| 529015 | 8/1956 | Canada | 401/291 |
| 496181 | 4/1930 | Fed. Rep. of Germany | 401/28 |

*Primary Examiner*—Steven A. Bratlie

*Attorney, Agent, or Firm*—Sughrue, Mion, Zinn, Macpeak & Seas

[57] ABSTRACT

A brush-type shower head is disclosed which may reduce residual detergent and contamination of the scalp and hair after shampooing. In the shower head, there are formed a plurality of water supply holes over a surface of the shower head. A plurality of projection members each having water communication holes are formed in the surface of the shower head. The water communication holes of the projection members are in communication with the water supply holes of the shower head. Under the condition that the projection members are held in contact with the scalp, water is supplied from the water communication holes of the projection members. Accordingly, the detergent components residual in the scalp or hair may be washed up without fail.

5 Claims, 12 Drawing Sheets

BRUSH-TYPE SHOWER HEAD

BACKGROUND OF THE INVENTION

The present invention relates to a brush-type shower head.

A variety of showers have conventionally been proposed. However, since a conventional shower head is so constructed that water is simply sprayed or sprinkled from a head surface, the water does not reach a user's scalp even if his or her hair is washed with shampoo. As a result, there is the possibility that surface activators, which are primary components of a shampoo may be left on the scalp. Accordingly, it is difficult to thoroughly wash hair in a short period of time with these devices.

The surface activators left on the scalp are condensed by a drier or the like, which is undesirable for the growth of the hair and for the scalp itself. Accordingly, there is a strong demand to provide a shower head which causes the hair and scalp to be washed while thoroughly removing shampoo components.

SUMMARY OF THE INVENTION

In order to meet the above-noted demands, according to the present invention, there is provided a brush-type shower head having a plurality of water supply holes dispersedly arranged over a surface of the head, the shower head comprising a plurality of projection members each having a communication hole, the projection members being formed on the surface of the head, the communication hole of each of the projection members being in communication with each of the water supply holes of the head.

According to another aspect of the present invention, there is provided a brush-type shower head having a plurality of water supply holes dispersedly arranged over a surface of the head, the shower head comprising a plurality of projection members each having at its distal end a water discharge hole for sprinkling water, wherein a water discharge window is formed in a side wall of each projection member for discharging water, and the water discharging hole and the water discharge window are in communication with each of the water supply holes.

According another aspect of the invention, a brush-type shower head has a plurality of water supply holes dispersedly arranged over a surface of the head, wherein an interior of the head is divided into an inner passage and an outer passage by an inner disc and an outer disc; a plurality of outer sleeves each having a discharge hole at a tip end for straight stream water supply are formed on a surface of the outer disc; a discharge window is formed in a side wall of each of the outer sleeves for side stream water supply; a plurality of inner sleeves are formed on a surface of the inner disc; a cutaway portion is formed in a side wall of each of the inner sleeves; and the inner sleeves are inserted into the outer sleeves, whereby water fed into the inner passage is straightly discharged in a dispersed manner to the outside through inner holes of the inner sleeves and the discharge holes of the outer sleeves, and water fed into the outer passage is laterally discharged in a dispersed manner to the outside through the cutaway portions of the inner sleeves and the discharge windows of the outer sleeves.

According to another aspect of the invention, there is provided a brush-type shower head having a plurality of water supply holes dispersedly arranged over a surface of the head, wherein an interior of the head is divided into an inner passage and an outer passage by an inner disc and an outer disc; a plurality of outer sleeves each having a discharge hole at a tip end for straight stream water supply are formed on a surface of the outer disc; a discharge window which is prevented from communicating with inner holes of the outer sleeves is formed in a side wall of each of the outer sleeves for side stream water supply; a plurality of inner sleeves are formed on a surface of the inner disc; and the inner sleeves are inserted into the outer sleeves, whereby water fed into the inner passage is straightly discharged in a dispersed manner to the outside through inner holes of the inner sleeves and the discharge holes of the outer sleeves, and water fed into the outer passage is laterally discharged in a dispersed manner to the outside through the discharge windows of the outer sleeves.

According to still another aspect of the invention, there is provided a brush-type shower head having a plurality of water supply holes dispersedly arranged over a surface of the head, wherein an interior of the head is divided into an inner passage and an outer passage by an inner disc and an outer disc; a plurality of straight water discharge sleeves each having at a tip end a water discharge hole for straight stream water are formed on the inner disc; a plurality of side stream water sleeves each having in a side wall a water discharge window for side stream water are formed on the outer disc; and the straight stream water sleeves are inserted into holes formed in the outer disc so that tip end portions of the straight stream water sleeves are projected from the outer disc, whereby water fed into the inner passage is straightly discharged to the outside through inner holes of the straight stream water sleeves and the discharge holes of the straight stream water sleeves, and water fed into the outer passage is laterally discharged to the outside through inner holes of the side stream water sleeves and the discharge windows of the side stream water sleeves.

According to still another aspect of the invention, there is provided a brush-type shower head having a plurality of water supply holes dispersedly arranged over a surface of the head, wherein water communication holes are formed in first bases made of resin; straight stream water sleeves which are provided at tip end portions have discharge holes for straight stream water and are made of resin are formed integrally with the first bases to form first resin-made blocks; and elongated projections made of resin are formed integrally along both sides in a longitudinal direction of bottom surfaces of second bases made of resin so that water communication passages are formed between the elongated projections and side stream water sleeves for side stream water are formed integrally with the second bases to form second resin-made blocks; the first blocks and the second blocks are arranged in a predetermined manner and are mounted in an opening formed in the surface of the head, whereby water introduced into the water communication passages through an outer passage defined by partitioning the head is straightly dispersedly discharged to the outside through the discharge holes of the straight stream water sleeves, and water introduced into the communication passages through an inner passage defined by partitioning the head is laterally dispersedly discharged to the outside through water discharge windows of the side stream water sleeves.

According to another aspect of the invention, there is provided a brush-type shower head having a plurality of water supply holes dispersedly arranged on a surface of the head, wherein a plurality of projection members having water discharge holes at tip ends thereof for straight stream water are formed on the surface of the head, and the discharge water holes and the water supply holes are in communication with each other.

DESCRIPTION OF THE PREFERRED EMBODIMENTS

The present invention will now be described with reference to the accompanying drawings which show preferred embodiments of the invention.

Figure 4:
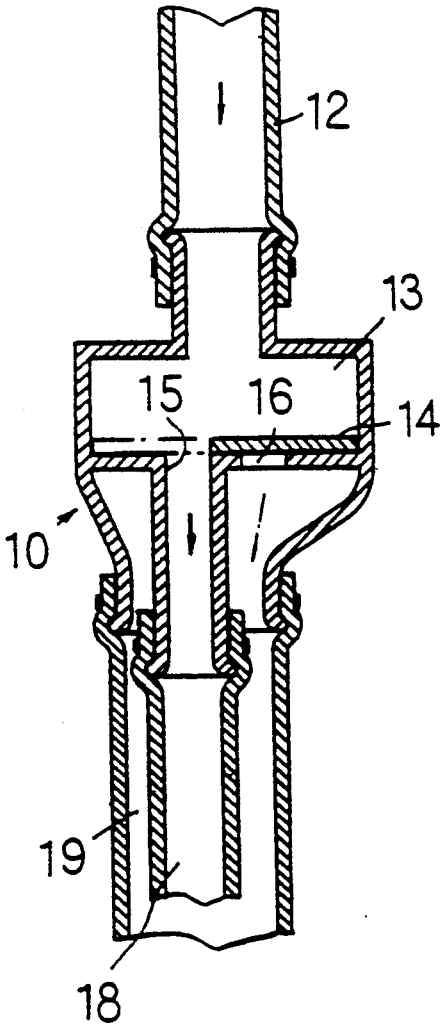
FIG. 4 is an enlarged cross-sectional view showing a switching-over section used in the shower system.
Figure 5:
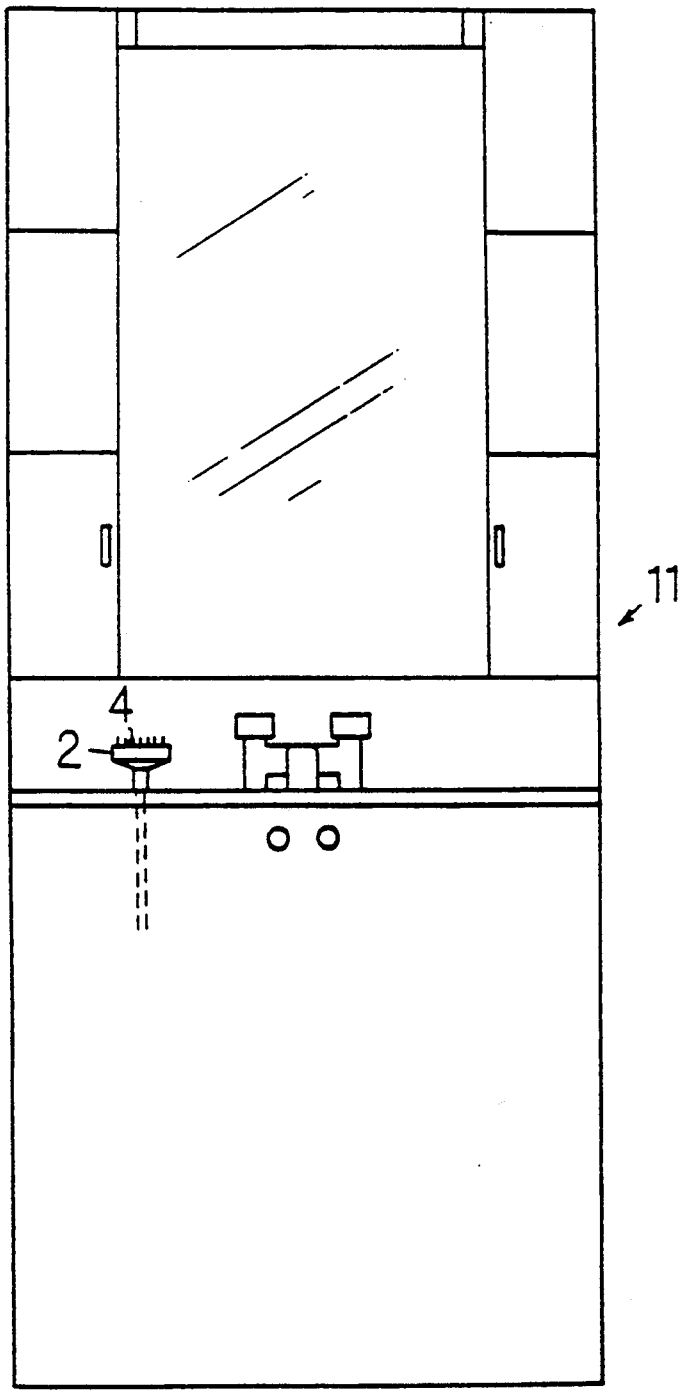
FIG. 5 is a frontal view showing an overall system of the shower using the shower head shown in FIG. 1.
Figure 6:
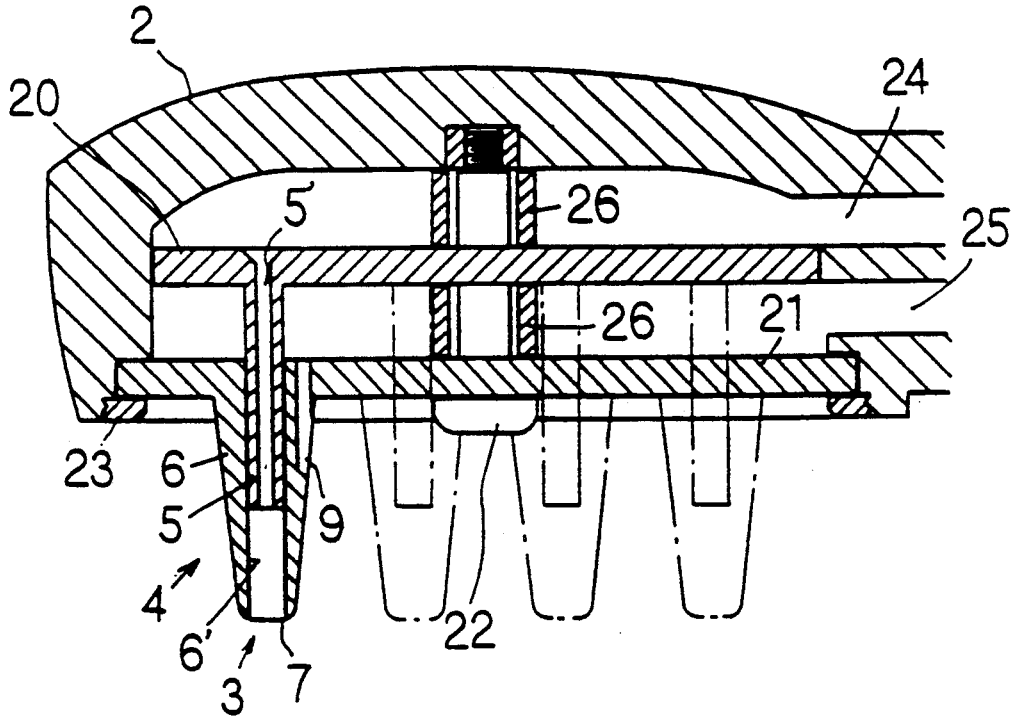
FIG. 6 is a cross-sectional view showing a shower head according to another embodiment of the invention.
Figure 7:
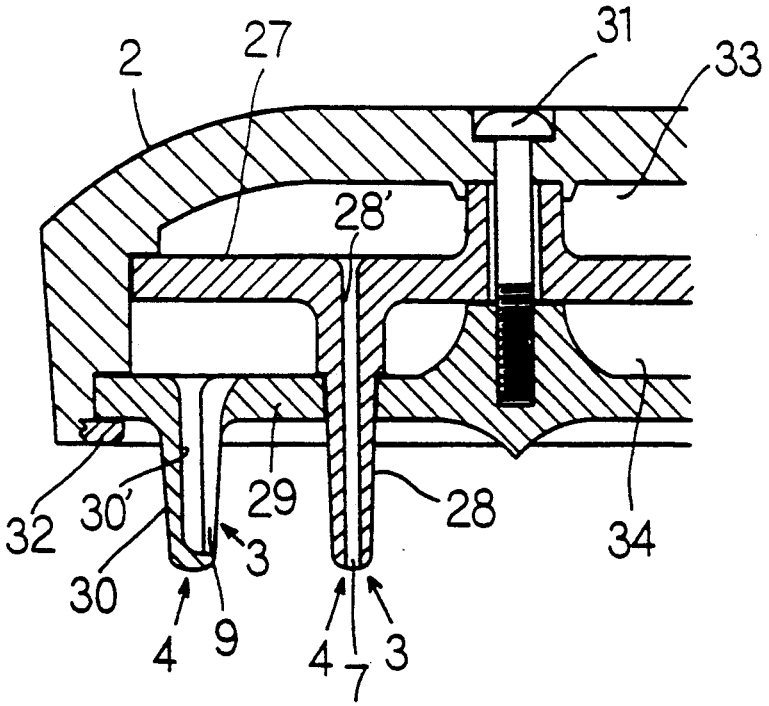
FIG. 7 is a cross-sectional view showing a shower head portion according to another embodiment of the invention.
Figure 8:
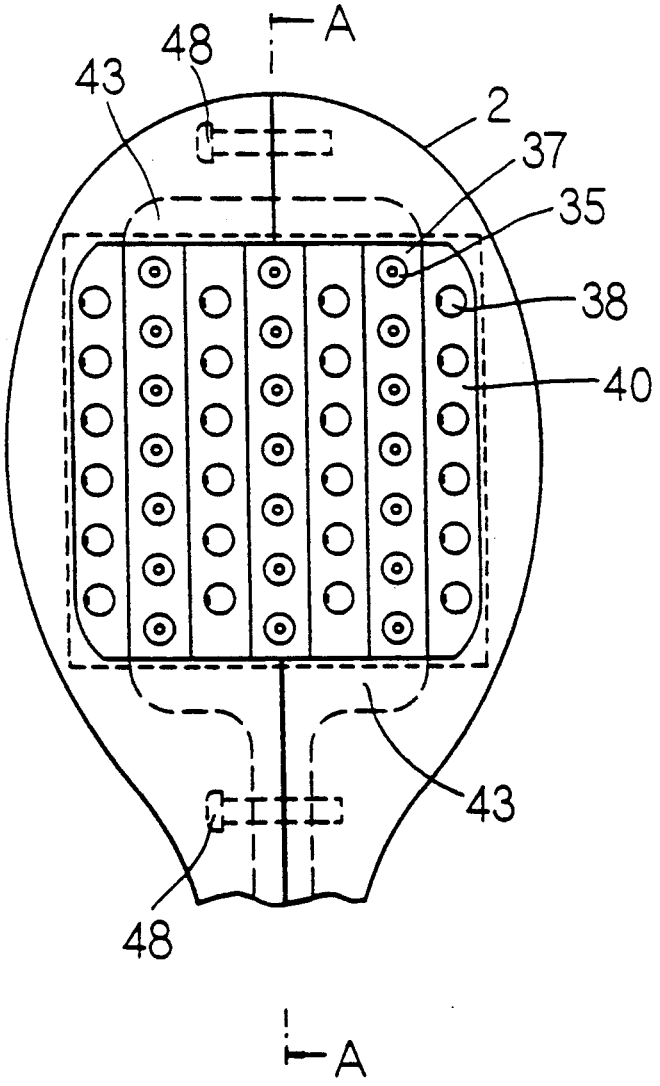
FIG. 8 is a frontal view showing a shower head in accordance with another embodiment of the invention.
Figure 9:
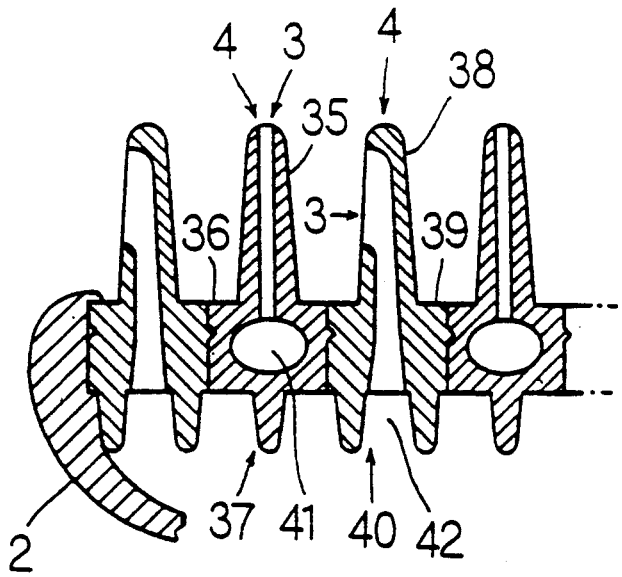
FIG. 9 is a cross-sectional view showing a primary part of the shower head shown in FIG. 8.
Figure 10:
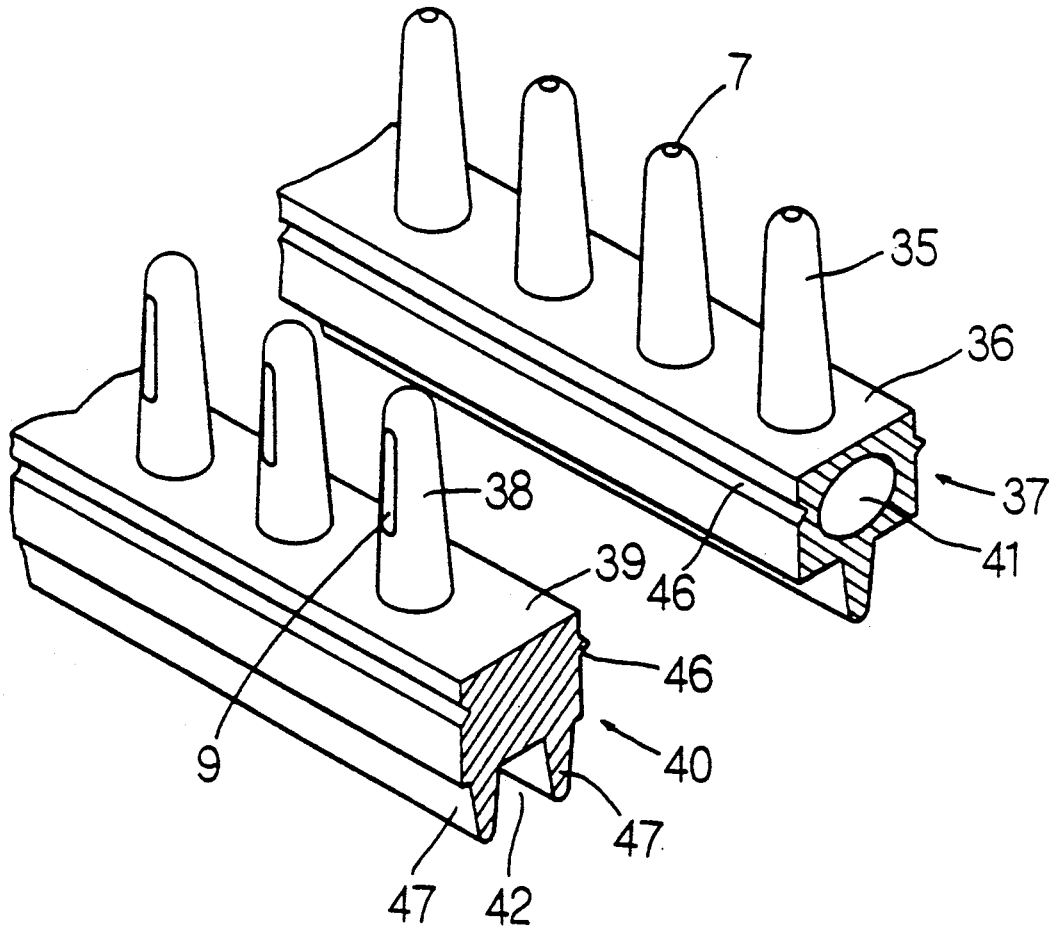
FIG. 10 is a perspective view showing the primary part shown in FIG. 8.
Figure 11:
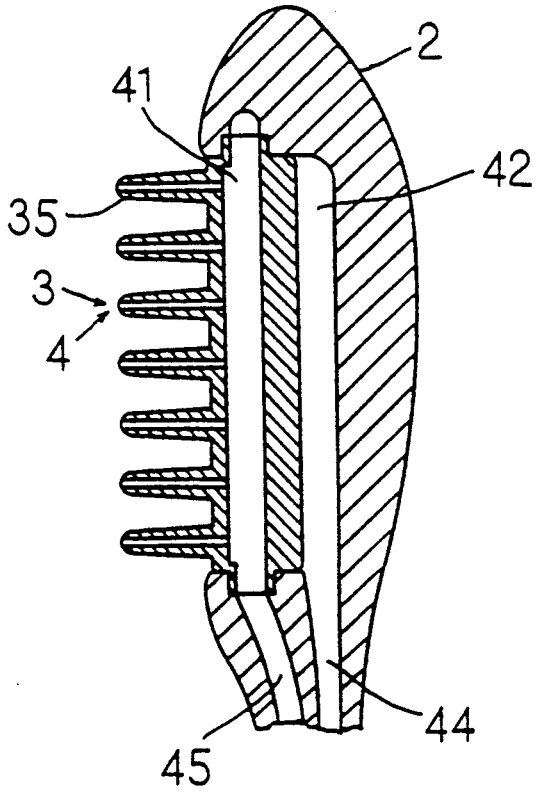
FIG. 11 is a cross-sectional view taken along the line A—A of FIG. 8.
Figure 12:
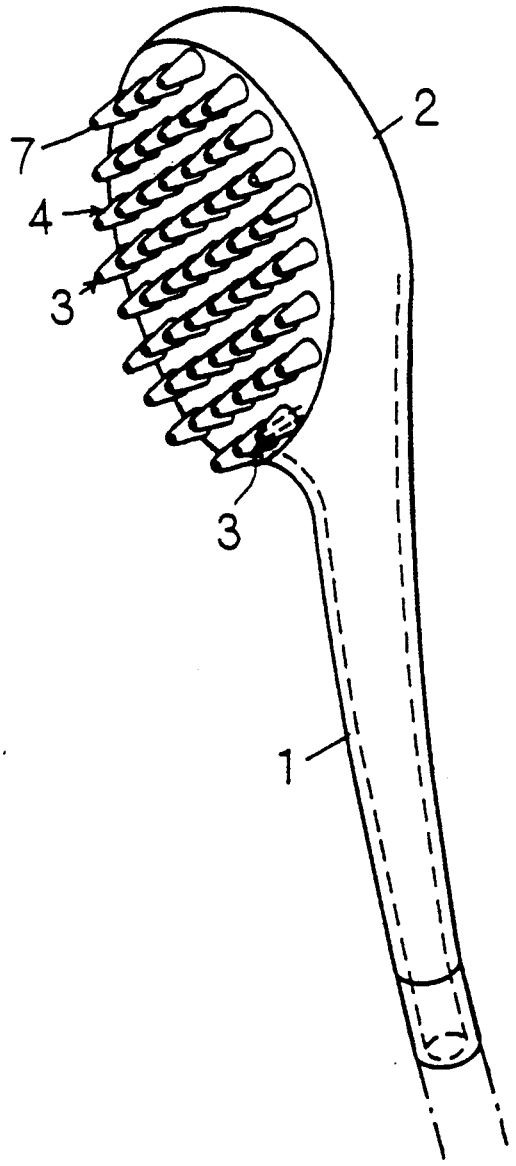
FIG. 12 is a perspective view showing a shower head in accordance with still another embodiment of the invention.

FIGS. 1 through 5 show a first embodiment in which each of projection members 4 is of the dual wall structure and a water discharge hole 7 and a water discharge window 9 are formed as water communication holes 3. FIG. 6 shows a second embodiment in which each of projection members 4 is of the dual wall structure and a water discharge hole 7 and a water discharge window 9 are formed as water communication holes 3. FIG. 7 shows a third embodiment in which two kinds of sleeves, i.e., a straight streamlined water sleeve 28 and a side streamlined water sleeve 30 are formed as projection members 4, and water discharge holes 7 and water discharge windows 9 are formed as water communication holes 3. FIGS. 8 through 11 show a fourth embodiment in which straight streamlined water sleeves 35 of a resin made block 37 and side streamlined water sleeve 38 of a resin made block 40 are formed as projection members 4, and water discharge holes 7 and water discharge windows 9 are formed as water communication holes 3. FIG. 12 shows a fifth embodiment in which a water communication hole 3 is formed at a tip end of each projection member 4 as a water discharge hole 7 without any water discharge window.

Figure 3:
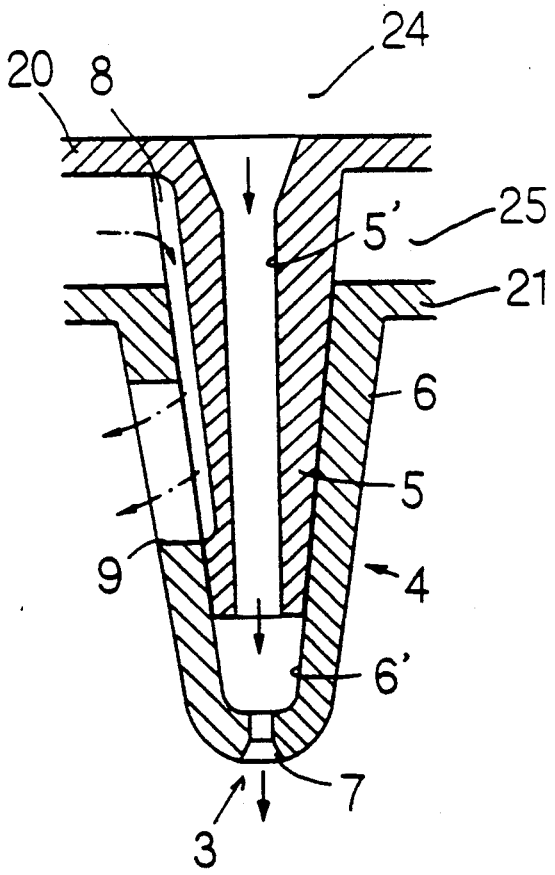
FIG. 3 is an enlarged cross-sectional view showing a projection member shown in FIG. 1.

The first embodiment will now be described. The shower head of the first embodiment relates to a waist-level shower sink 11 as shown in FIG. 5. As best shown in FIG. 3, each projection member 4 is of the dual wall structure composed of a tapered inner sleeve 5 and a tapered outer sleeve 6. In the case where the water is fed from an inner passage 24 located on the upper side of FIG. 3 inside of the inner sleeve 5, the water is discharged through a space defined by an inner hole 5' of the inner sleeve 5 and an inner hole 6' of the outer sleeve 6 from a water discharge hole 7 at the tip end of the outer sleeve 6. Also, in the case where the water is fed from a space between the inner sleeve 5 and the outer sleeve 6 from an outer passage 25, the water is discharged through a cutaway portion 8 of the inner sleeve 5 and a water discharge window 9 of the outer sleeve 6.

Figure 1:
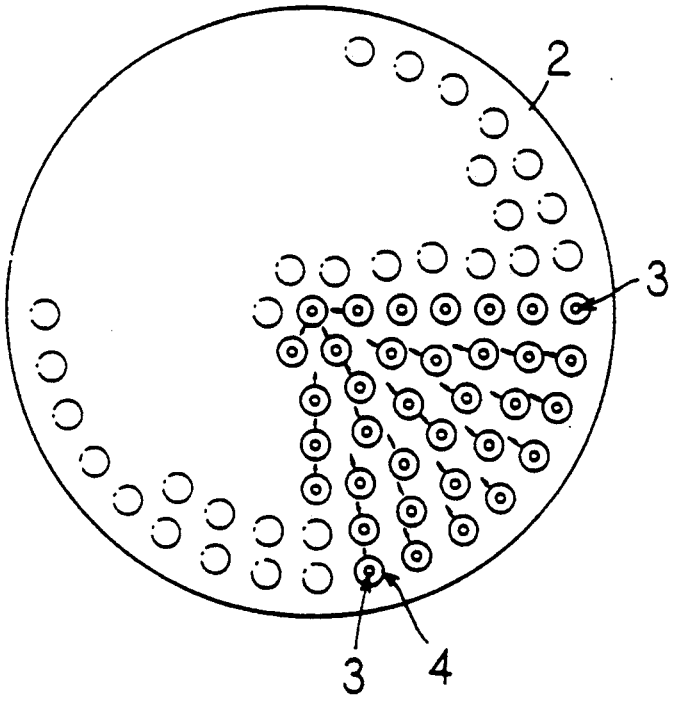
FIG. 1 is a frontal view showing a shower head according to one embodiment of the invention.

It should be noted that the cutaway portions 8 of the inner sleeves 5 are formed so that the water is normally discharged radially inwardly toward a center of a head 2 as indicated by arrows in FIG. 1.

Figure 2:
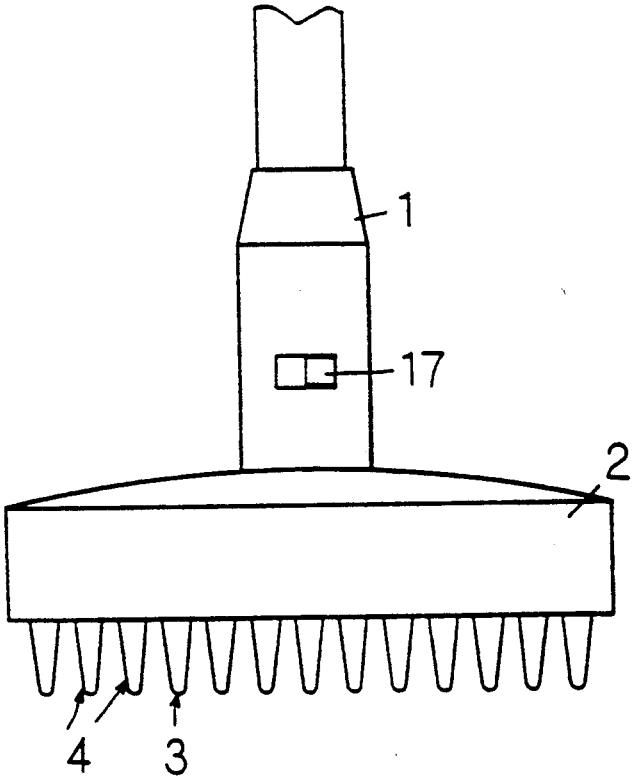
FIG. 2 is a side elevational view of the shower head shown in FIG. 1.

A switching-over action between the water discharge from the water discharge holes 7 of the outer sleeves 6 or the water discharge from the water discharge windows 9 is effected by using a knob 17 (FIG. 2).

FIG. 4 shows an example of a switching portion 10 driven by the knob 17 in accordance with the first embodiment. The water flowing through an introduction pipe 12 is temporarily stored in a chamber 13 and subsequently is discharged from a passage 18 through the inner passage 24, the inner hole 5' of the respective inner sleeves 5, the inner hole 6' of the respective outer sleeve 6, passages of the respective water discharge holes 7, or alternatively through a passage 19, the outer passage 25, the cutaway portions 8 of the respective inner sleeves 5 and the passages of the water discharge windows 9 by changing a position of a planar valve 14 in response to the movement of the knob 17. FIG. 4 shows the former flow system.

The structure of the switching portion 10 is not limited to that shown in FIG. 4 but it is possible to design the structure in any desired manner. Incidentally, in FIG. 2, reference numeral 1 denotes a grip portion.

With such a structure of the shower head in accordance with the first embodiment, it is possible to wash hair while massaging the scalp with the outer sleeves 6. At the same time, since the tip ends of the outer sleeves 6 are brought into contact with the scalp, the detergent components stuck to the scalp may be rinsed off in a short period of time with a small amount of water.

The shower head according to the first embodiment is particularly useful in washing long hair while raising it with the hands.

If the water is activated by using the electric stone proposed by the present applicants in, for example, Japanese Utility Model Unexamined Publication No. Hei 2-80336, Japanese Utility Model Unexamined Publication No. Hei 2-80450 and Japanese Utility Model Unexamined Publication No. Hei 2-96373 and is passed through the shower head in accordance with the first embodiment, it is possible to eliminate the shampoo components or reduce the amount of the shampoo due to the surface activation effect of the water. At the same time, since residual chlorine which is contained in the public water is electrically soluble with the water, there is less likelihood that the scalp and hair will be damaged.

If the activated water is thus used, it is possible to expect a public profit like enhancement of water quality by saving the amount of consumed water.

FIG. 6 shows a second embodiment in which the shape of the head is different from that of the first embodiment, and it is possible to change the direction of water supply as in the first embodiment. Reference numeral 20 denotes an inner disc having the inner sleeves 5, reference numeral 21 denotes an outer disc having the outer sleeves 6, reference numeral 22 denotes a screw, numeral 24 denotes an inner passage, numeral 25 denotes an outer passage, and numeral 26 denotes a spacer.

With such a structure in accordance with the second embodiment, it is possible to accomplish switching of the water supply directions by switching over the inner passage 24 and the outer passage 25 with a suitable means in the same manner as in the first embodiment. Additional structure is the same as that of the first embodiment.

FIG. 7 shows a third embodiment in which the head structure is the same as that of the second embodiment, and it is possible to switch over the water supply directions in the same manner as in the first embodiment. Numeral 27 denotes an inner disc having straight streamlined sleeves 28, numeral 29 denotes an outer disc having side streamlined sleeves 30, numeral 31 denotes a fastening screw, numeral 32 denotes a ring screw, numeral 33 denotes an inner passage, and numeral 34 denotes an outer passage.

With such a structure in accordance with the third embodiment, it is possible to accomplish switching of the water supply directions by switching the inner passage 33 and the outer passage 34 with a suitable means in the same manner as in the first embodiment. The other effect is the same as that of the first embodiment.

FIGS. 8, 9, 10 and 11 show a fourth embodiment in which a shape of a head 2 is the same as that of the second embodiment, and it is possible to switch over the water supply directions in the same manner as in the first embodiment.

In the fourth embodiment, the straight streamlined sleeves 35 are formed integrally with a base 36. A water communication hole 41 is formed in the base 36 formed of a resin block 37. Side streamlined sleeves 38 are projecting from an upper surface of base 39 formed of a resin block 40. Elongated projections 47 are provided on both edges of a lower surface of the base 39. A desired number of resin made blocks 40 each have a water passage 42 between the elongated projections 47. The desired numbers of the blocks 37 and 40 are fitted in an opening portion 43 of a central portion of the head 2 in a dividable manner. Numeral 44 denotes an inner passage, numeral 45 denotes an outer passage, numeral 46 denotes engagement retaining portion, and 48 denotes screws for fastening the dividable head 2.

With such an arrangement according to the fourth embodiment, it is possible to set the water supply directions at a desired direction by suitably combining the resin made blocks 37 and 40. Since the resin made blocks 37 and 40 are made integrally of resin, it is possible to mass produce the blocks.

It is possible to switch the water supply directions by switching over the inner passage 44 and the outer passage 45 with a suitable means in the same manner as in the first embodiment. The other effect is the same as that of the first embodiment.

FIG. 12 shows a fifth embodiment in which a shape of a head 2 is different from that of the first embodiment, and the water supply is carried out only from the water discharge holes 7 provided at the tip ends of the projection members 4.

As described above, according to the present invention, it is possible to wash the root portions of hair and head skin in a good condition. Accordingly, it is possible to provide a brush-type shower head which is excellent in health and aesthetics without any residual detergent on the scalp.

What is claimed is:

1. A brush type shower head having a plurality of water supply holes dispersedly arranged over a surface thereof, comprising:

a housing;

a plurality of resin bases each having a water communication passage associated therewith;

a plurality of water sleeves, each having a discharge hole formed therein, said water sleeves being integrally formed with one of said resin bases so as to place said discharge holes in communication with an associated one of said water communication passages;

said resin bases being arranged in said housing so as to place said water communication passages in communication with an interior of said housing, water introduced into said housing being directed out of said discharge holes.

2. A brush type shower head as recited in claim 1, wherein said discharge holes are formed at tip end portions of said water sleeves so as to direct water passing therethrough away from said housing.

3. A brush type shower head as recited in claim 1, wherein said discharge holes are formed on a side portion of said water sleeves so as to direct water passing therethrough in a lateral direction with respect to said housing.

4. A brush type shower head as recited in claim 1, wherein said resin bases comprise a plurality of first blocks and a plurality of second blocks, said first blocks each having a first water communication passage formed therein and a plurality of first water sleeves formed thereon, said first water sleeves having a discharge hole formed at a tip end portion thereof so as to direct water passing therethrough away from said housing, said second blocks each having a pair of elongated projections formed on a bottom surface and extending in a longitudinal direction thereof, said pair of elongated projections defining a second water communication passage associated with one of said second blocks, a plurality of second water sleeves having a discharge hole formed on a side portion thereof so as to direct water passing therethrough in a lateral direction, with respect to said housing, being formed on said second blocks, said interior of said housing being divided into first and second portions by a partition, said first portion being in communication with said first water communication passages and said second portion being in communication with said second water communication passages.

5. A brush-type shower head, comprising:

a handle having an outer passage formed therein;

at least one first resin base having a first water communication passage formed therein;

at least one straight stream water sleeve integrally formed on said first resin base and being in communication with said first water communication passage, said straight stream water sleeve having a first discharge hole formed at a tip portion thereof;

at least one second resin base;

a pair of elongated projections formed on said second resin base, said elongated projections extending along said second resin base in a longitudinal direction thereof so as to define a second water communication passage;

at least one side stream water sleeve integrally formed on said second resin base and being in communication with said second water communication passage, said side stream water sleeve having a second discharge hole formed in a side portion thereof;

said first and second resin bases being mounted in an opening formed in said handle in a predetermined manner whereby water introduced into said first water communication passage through said outer passage is discharged in a radial direction with respect to a surface of said first and second resin bases through said first discharge hole, and water introduced into said second water communication passage is discharged in a lateral direction with respect to said surface through said second discharge hole.

* * * * *